United States Patent [19]

Bowen

[11] 4,385,711

[45] May 31, 1983

[54] CHILD RESISTANT CLOSURE ASSEMBLY

[75] Inventor: James L. Bowen, Fort Ann,; Amelio J. Cocci, Glens Falls, both of N.Y.

[73] Assignee: Genpak Corporation, Glens Falls, N.Y.

[21] Appl. No.: 286,640

[22] Filed: Jul. 24, 1981

[51] Int. Cl.[3] ..... B65D 17/52; B65D 43/26

[52] U.S. Cl. ..... 220/284; 220/306; 215/215

[58] Field of Search ..... 220/284, 306, 307; 260; 215/215

[56] References Cited

U.S. PATENT DOCUMENTS 4,335,827 6/1982 Knize et al. ..... 220/284

*Primary Examiner*—George T. Hall

*Attorney, Agent, or Firm*—Stevens, Davis, Miller & Mosher

[57] ABSTRACT

An improved plastic container and closure comprising an open end container having a bottom and side wall extending upwardly therefrom; a cylindrical collar connected to the side wall through an annular transverse wall, the collar and annular transverse wall having at least one vertical slot therein, the side wall below the upper edge of the container having an external annular shoulder; and a closure defining a circular disk and a cylindrical skirt extending from the periphery thereof, the skirt on the inside thereof having an annular shoulder spaced from the disk a distance greater than the distance of the shoulder on the container from its upper edge so that when the closure is fitted over the container the skirt fits between the container wall and collar and the shoulder on the skirt snaps over the shoulder on the container to maintain the closure in a fitted position.

5 Claims, 3 Drawing Figures

CHILD RESISTANT CLOSURE ASSEMBLY

The invention relates to a child resistant closure assembly for storing materials which may be harmful to children. More particularly, the closure assembly comprises a container having an annular wall the outside of which is connected to a collar by an annular transverse wall and carries a peripheral shoulder thereon and a closure comprising a circular disk to which is attached a skirt the interior of which defines an annular shoulder which interlocks with the shoulder of the container. The collar and transverse wall have at least one vertical slit therein to permit the insertion of an instrument to lift the skirt thereby disengaging the closure from the container.

BACKGROUND OF THE INVENTION

Child proof closure assemblies are known in which entry to the closure assembly is brought about by rupturing a portion of the closure wall. However, in such child proof closure assemblies, the closure is child proof only for the initial opening. Once the closure wall is ruptured subsequent openings become easy and not child proof.

Child proof closure assemblies also are known in which an instrument is required in order to rotate the closure to open it, the closure being child proof in the sense that the closure cannot be opened without the instrument. However, with the rotation of the closure certain camming surfaces are additionally required thereby making the design of the closure assembly more intricate and more costly.

It is therefore an object of this invention to provide a closure assembly which is as child proof on its last opening as on its first opening.

A further object of this invention is to provide a closure assembly of simple construction which requires an instrument to open it but is free of camming surfaces.

SUMMARY OF THE INVENTION

These objects are attained through a closure assembly of the type outlined at the beginning of this description wherein, according to the invention, the closure assembly comprises an open end container and a closure. The container has a bottom and a side wall extending upwardly therefrom, a cylindrical collar connected to the side wall through an annular transverse wall, and at least one vertical slit within the collar and annular transverse wall. The side wall below the upper edge of the container has an external annular shoulder. The closure is comprised of a circular disk to which is attached a cylindrical skirt extending from the periphery thereof. The skirt on its inside has an annular shoulder spaced from the disk a distance greater than the distance of the shoulder on the container is from the upper edge of the container so that when the closure is fitted over the container the skirt fits between the container wall and the collar and the shoulders interlock to maintain the closure in a fitted tight position.

BRIEF DESCRIPTION OF THE DRAWINGS

Other details and features of the invention will stand out from the description given below by way of non-limitative example and with reference to the accompanying drawings, in which.

DESCRIPTION OF THE PREFERRED EMBODIMENT

Figure 1:
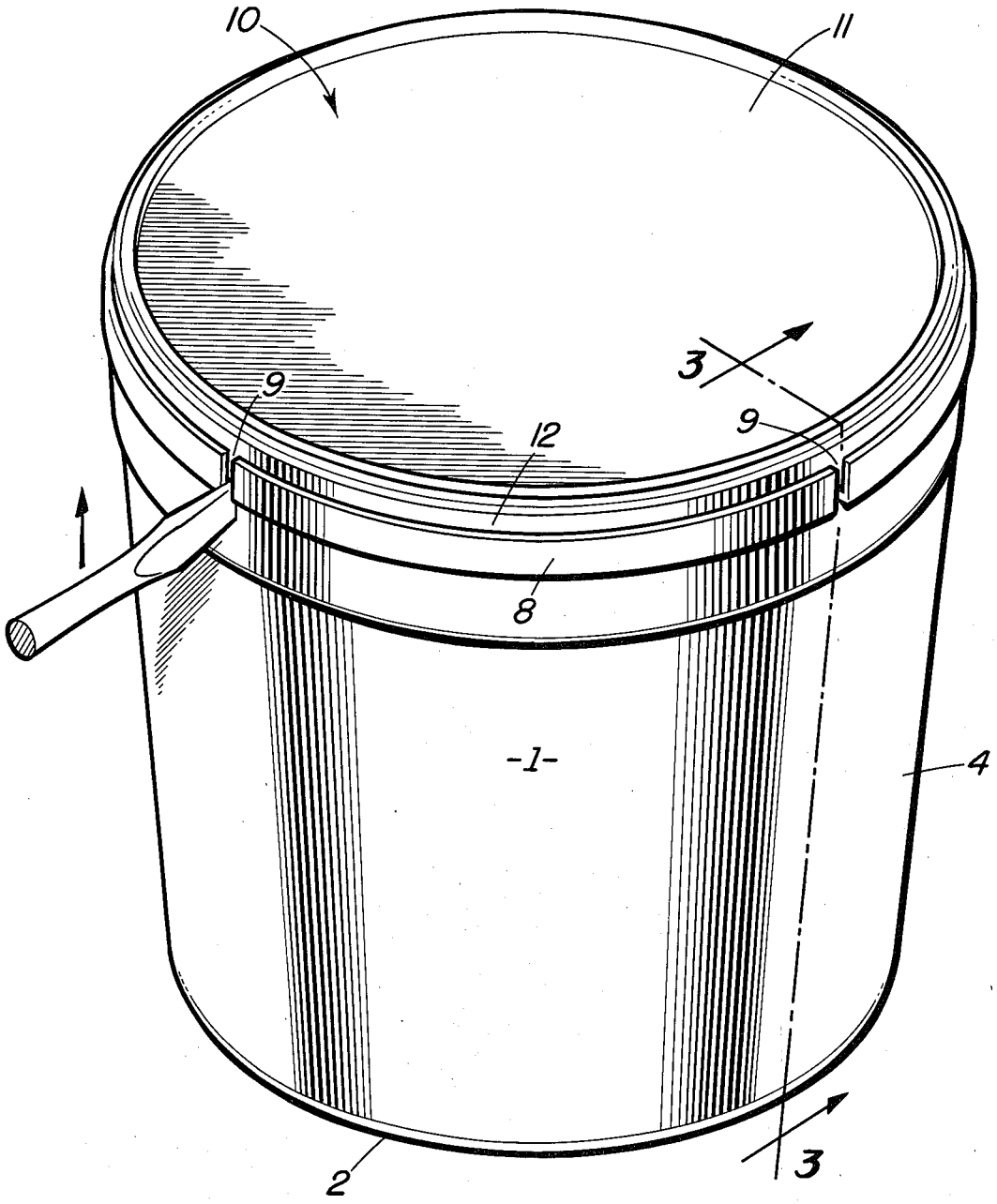
FIG. 1 is a side elevational view of the container with the closure in place and the instrument for opening according to the invention.
Figure 2:
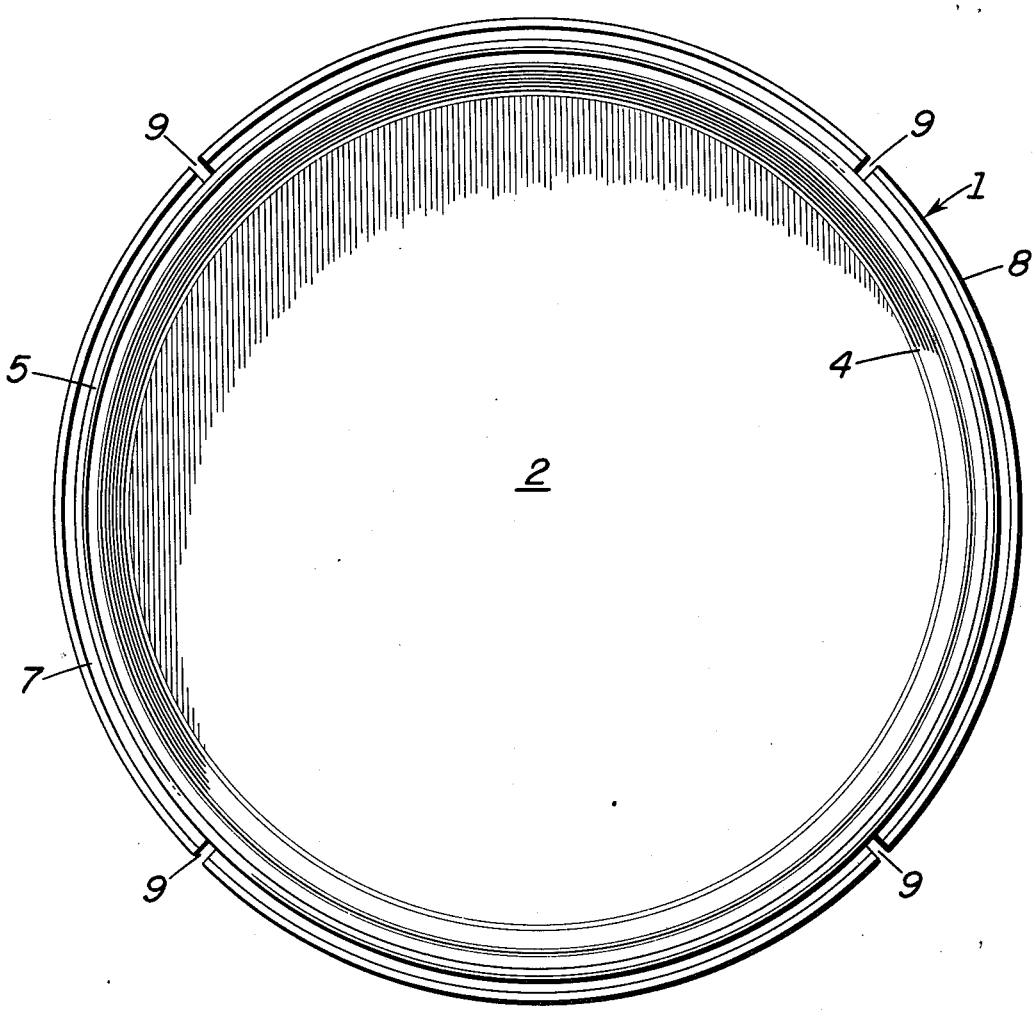
FIG. 2 is a top view of the container without the closure.
Figure 3:
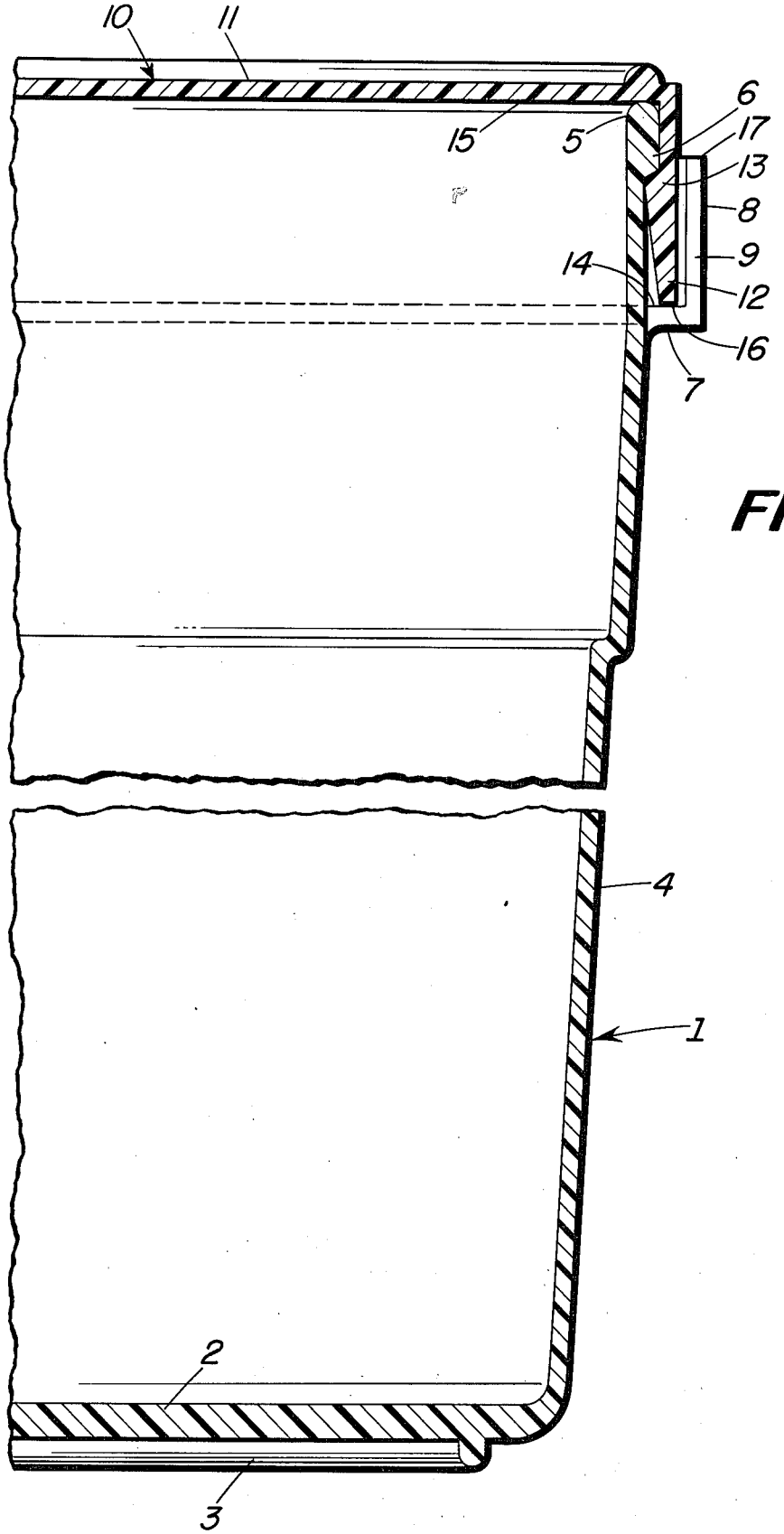
FIG. 3 is a cross-sectional view on a larger scale taken along line 3—3 of FIG. 1.

Referring to the drawings the container 1 has a circular bottom 2 on to which is formed an annular base 3 utilized to align the closure assembly when stacking. Attached to the bottom is a side wall 4 which may be cylindrical or tapered toward the bottom extending to an upper edge 5. On the outside of side wall 4 near the upper edge 5 is an annular shoulder 6. Below the annular shoulder 6 is an annular transverse wall 7 to which is attached an upwardly extending collar 8. Collar 8 does not extend upwardly as far as edge 5 but does extend above shoulder 6. Cut in transverse wall 7 and collar 8 is at least one vertical slot 9. If there is more than one vertical slot the slots are spaced equally apart around the collar and wall. Although it is necessary to have only one vertical slot it is preferred to have a plurality. The closure 10 is composed of a circular disk 11 to which is attached a skirt 12. On the interior of skirt 12 is an annular shoulder 13 which interlocks with shoulder 6 when the closure 10 is pressed down over the wall 4. The skirt 12 is of a length to have its lower edge 16 rest on the upper surface 14 of the transverse wall when the closure is in place. Also when the closure is in place the lower surface 15 of the disk 11 rests on edge 5. The collar 8 is sufficiently thin and pliable to prevent the closure assembly from being opened through pivoting on the upper edge 17 of the collar 8 with an instrument introduced between the collar 8 and skirt 12. Thus the only way that the closure can be removed from the container is to insert a thin instrument such as a screwdriver into the slot 9 below the skirt 12 and lift while the container is held in place. The lifting of the skirt disengages the interlocking shoulders and permits easy removal of the closure.

The container and closure are formed of plastic materials such as polypropylene and polyethylene.

It is obvious that modifications can be made to the foregoing without departing from the spirit and scope of the invention.

What is claimed is:

1. An improved plastic container and closure comprising:

a. an open end container having a bottom and side wall extending upwardly therefrom; a cylindrical collar connected to the side wall through an annular transverse wall, said collar and annular transverse wall having at least one vertical slot therein, said side wall below the upper edge of the container having an external annular shoulder; and b. a closure defining a circular disk and a cylindrical skirt extending from the periphery thereof, said skirt on the inside thereof having an annular shoulder spaced from the disk a distance greater than the distance of the shoulder on the container from its upper edge so that when the closure is fitted over the container the skirt fits between the container wall and collar and the shoulder on the skirt snaps over the shoulder on the container to maintain the closure in a fitted position.

2. The plastic container and closure of claim 1 wherein said collar and annular transverse wall have a plurality of vertical slots therein equally spaced thereabout.

3. The plastic container and closure of claim 1 or claim 2 wherein the collar extends below the upper edge of the container.

4. The plastic container and closure of claim 1 wherein the edge of the skirt of the closure rests against the annular transverse wall of the container when said closure is in place.

5. The plastic container and closure of claim 1 wherein the underside of said disk seats on the upper edge of said container when said closure is in place.

* * * * *